United States Patent [19]

Grow et al.

[11] 4,177,718

[45] Dec. 11, 1979

[54] FUME HOOD

[75] Inventors: Harry N. Grow, Two Rivers; Jon A. Zboralski, Manitowoc, both of Wis.

[73] Assignee: American Hospital Supply Corporation, Evanston, Ill.

[21] Appl. No.: 928,463

[22] Filed: Jul. 27, 1978

[51] Int. Cl.[2] ..... F23J 11/00

[52] U.S. Cl. ..... 98/115 LH; 98/119; 55/DIG. 15; 422/104

[58] Field of Search ..... 98/115 R, 115 LH, 116, 98/119; 422/104; 55/DIG. 15

[56] References Cited

U.S. PATENT DOCUMENTS

| | | | |
|---|---|---|---|
| 2,715,359 | 8/1955 | Mackintosh et al. | 98/115 LH |
| 3,340,788 | 9/1967 | Landingham et al. | 98/115 LH |
| 3,403,616 | 10/1968 | Nelson | 98/119 |
| 3,604,333 | 9/1971 | Nelson | 98/115 LH |
| 3,747,504 | 7/1973 | Turko et al. | 98/115 LH |
| 3,877,357 | 4/1975 | Felter et al. | 98/116 |
| 4,023,473 | 5/1977 | Russell | 98/115 LH |

*Primary Examiner*—Ronald C. Capossela
*Attorney, Agent, or Firm*—Larry N. Barger

[57] ABSTRACT

A fume hood with an air actuated valve system for directing a mixture of room and external air in front of a horizontal sash when such sash is open, and behind this sash when it is closed.

14 Claims, 3 Drawing Figures

CLOSED
EXTERNAL AIR
ROOM AIR

OPEN 28
24
27
23
22
18
26
26
25
30
20

FUME HOOD

BACKGROUND

To conserve heated or cooled room air, it is common practice in exhaust pipe fume hoods to mix external air from outside a building with room air for sweeping fumes out of the building through an exhaust system. Such air mixing fume hoods are described in U.S. Pat. No. 3,340,788 and 3,747,504.

Both of the above patents describe fume hoods with vertically movable sashes to open and close a front opening of the fume hood. In FIGS. 9 and 10 of U.S. Pat. No. 3,747,504, structure is shown in which the vertically movable sash acts as a valve to direct the auxiliary air flow in front of the sash to help sweep fumes and room air into the fume hood when the vertical sash is open. When the vertical sash is closed, the major portion of external air flows behind the sash, directly into the fume hood, and can also help draw in some room air. This prevents the external air from dumping into the room when the sash is closed, putting additional burdens on the heating and cooling equipment of a building.

In certain fume hoods, it is desirable to have the sashes move horizontally. This is particularly true in a large walk-in fume hood in which the sashes, i.e. sliding doors, extend to the floor. U.S. Pat. No. 3,604,333 has attempted to provide a valving system in a horizontally movable sash in which a series of complex dampers are controlled by the movement of the sash. Because of the weight, suspension system, etc. of horizontally movable sashes, it is very difficult to provide a reliable valving system that does not put excessive drag on the horizontally sliding sashes.

SUMMARY OF THE INVENTION

The present invention overcomes the above problems with horizontally sliding sashes. This invention has an inner flow actuated valving system for directing the supply air in one direction when the sash is open, and in another direction when the sash is closed. This air actuated valve does not require a mechanical linkage or connection to the sash to open and close the valve.

THE DRAWINGS

DETAILED DESCRIPTION

Figure 1:
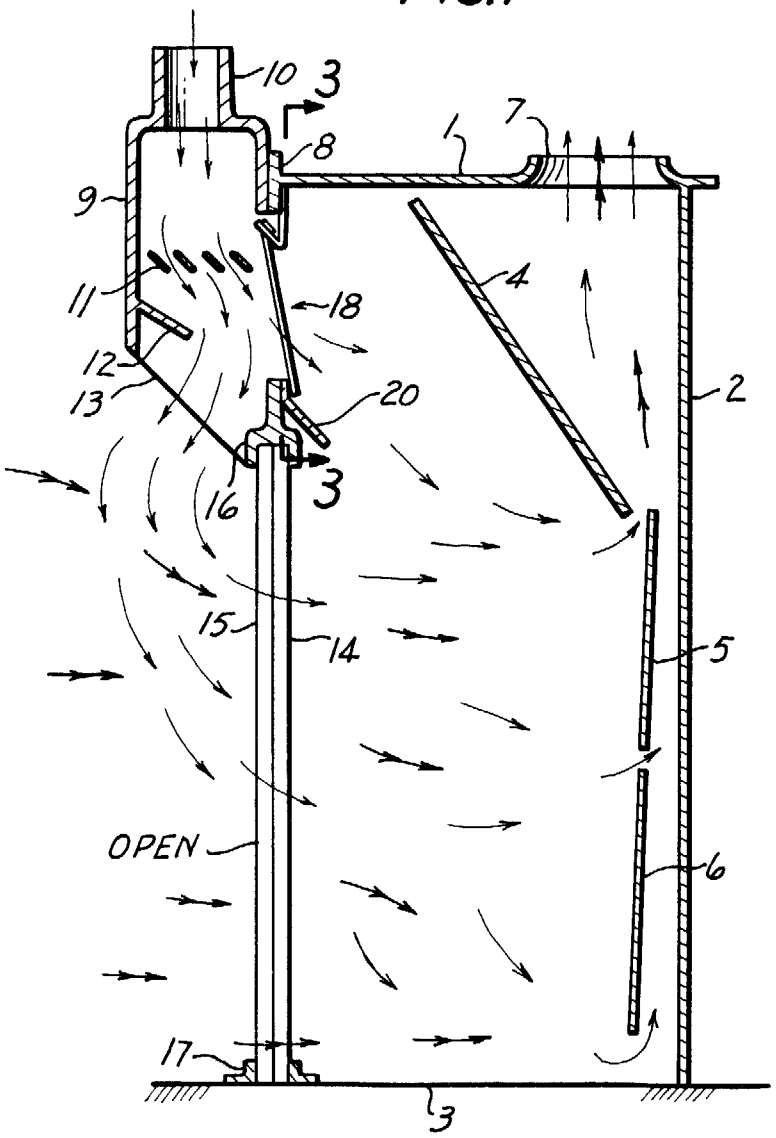
FIG. 1 is a schematic sectional view of a walk-in fume hood with horizontally slidable sashes in open position showing the air flow.

FIG. 1 shows a walk-in fume hood housing with a top 1, a back 2, and a base or floor 3. Internally, a series of baffles 4, 5, and 6 help direct the fumes and air supply toward an exhaust vent structure 7 that is connected to a blower and venting duct system (not shown).

On a forward wall section 8 of the fume hood is mounted an external air collector housing 9, which can be connected through duct work at 10 to an external or auxiliary blower (not shown). If desired, housing 9 can include a directional grate 11 and a baffle 12 to help direct incoming external air toward the fume hood's interior. A bottom portion 13 of housing 9 is open to the room immediately in front of the horizontal sashes, two of which are shown as 14 and 15. It is understood that three or four overlapping sliding sashes could be used, if desired. Sashes 14 and 15 are shown schematically connected to an upper track 16 and a lower track 17.

In FIG. 1, the sashes 14 and 15 have been opened, such as sliding them into overlapping relationship as with sliding doors. Thus, the external air in FIG. 1 is directed in front of the open sashes to help combine with the room air and sweep the fumes into the hood's interior. A small amount of external air will bleed past air actuated valve 18 which is shown here in closed position. The structure of valve 18 will be explained later in reference to FIG. 3.

Figure 2:
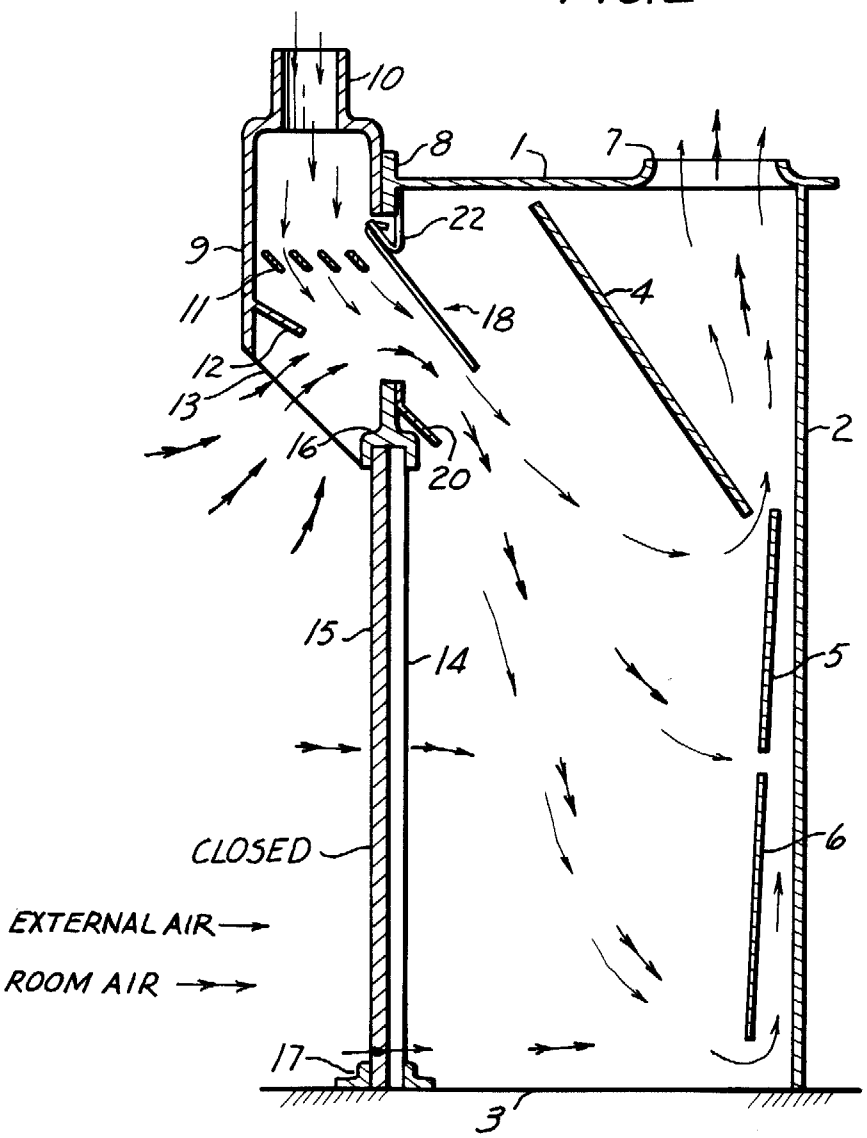
FIG. 2 is a view similar to FIG. 1, but showing the sashes in closed position.

When the sashes 14 and 15 are closed as in FIG. 2, there will be a small amount of room air which leaks past the closed sashes. However, the majority of room air entering the hood will enter through chamber 9 where it will combine with external air and provide a greater air flow rate of the combined external and room air through valve 18 than when the sashes are open, as in FIG. 1. This high air flow rate in FIG. 2 automatically opens valve 18 without requiring any mechanical linkage to the movement of sashes 14 and 15. To help direct the incoming air (external and room) to a rear of the fume hood, a rearwardly and downwardly sloping baffle 20 is preferably located at an openable throat section adjacent valve 18.

Figure 3:
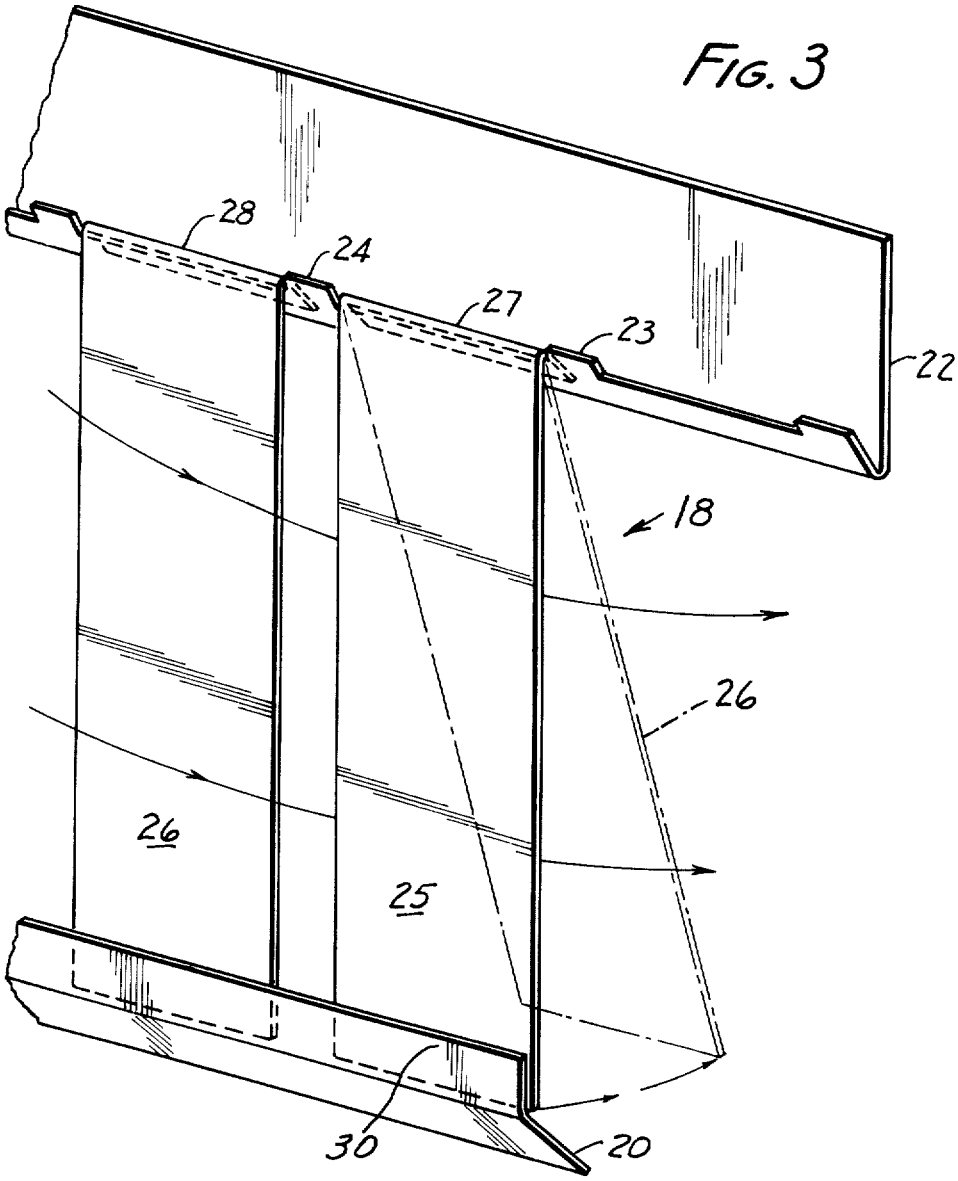
FIG. 3 is a rear prospective view taken along line 3—3 of FIG. 1 showing a pivoted strip construction of the air actuated valve system.

The valve 18 is shown in greater detail in FIG. 3. Here a supporting bar 22 has a series of upturned spacer lugs 23 and 24. Valve 18 also includes a series of strips 25 and 26 with hook sections 27 and 28 fitting over supporting bar 22. A lower portion of these strips rest against a stop bar 30 which can be integral with or connected to baffle 20.

As shown in FIG. 3, the spacer lugs provide a gap between the strips. This provides a small amount of air bleed into the fume hood when the sashes are open, as in FIG. 1. This external air bleed into the hood guards against any of the fumes at an upper portion of the hood seeping out into chamber 9. However, as shown in FIG. 3, the strips are in their closed position and the entire valve, including the series of strips, is considered generally closed.

When the sashes 14 and 15 are closed, the high flow rate of the combined external and room air automatically opens the valve by causing the strips to swing inwardly, as shown in dotted line with strip 26. It is understood that because of air currents, etc., all strips will not swing to precisely the same angle. In fact, some strips may be opened wide, while others may remain closed. The weight of the strips cause them to automatically close when the sashes are opened, as in FIG. 1. It has been found that the air actuated valve works extremely well when the strips are made of 0.024 inch aluminum sheet, and are approximately 3 inch wide. The spacer lugs work well when approximately ¾ inch in width. It is understood that different materials and dimensions of the strips can be used to vary the operating characteristics of the valves. Also, if desired, the strips could be secured by a pivot pin or be of flexible material, such as rubber or plastic, with one pin anchored to the supporting bar 22.

In the foregoing description, a specific example has been used to describe the invention. However, it is understood by those skilled in the art that certain modifications can be made to this example without departing from the spirit and scope of the invention.

We claim:

1. A fume hood with an inlet for external air and an openable sash for operator access to an interior of the hood, wherein the improvement comprises: an air supply actuated valve means in flow communication with the hood for directing an air supply through a sash opening in the hood when the sash is open, and for directing an air supply around the sash into the hood when the sash is closed.

2. A fume hood as set forth in claim 1, wherein the fume hood has structure for combining room and external air into an air supply for sweeping fumes out of the hood through an exhaust.

3. A fume hood as set forth in claim 2, wherein the valve means direct external air in front of the sash when such sash is open, and behind the sash when such sash is closed.

4. A fume hood as set forth in claim 1, wherein the valve means includes an air movable member.

5. A fume hood as set forth in claim 4, wherein the valve means includes a series of air movable strips.

6. A fume hood as set forth in claim 5, wherein the series of air movable strips are spaced apart with air bleed gaps between adjacent strips.

7. A fume hood as set forth in claim 5, wherein the air movable member includes a strip with a supporting hook section at its upper end to act as a pivot means.

8. A fume hood as set forth in claim 5, wherein the valve includes a supporting bar with upturned spacing lugs for separating a series of air movable strips.

9. A fume hood as set forth in claim 5, wherein the air movable member includes a series of strips elongated in a vertical direction.

10. A fume hood as set forth in claim 9, wherein the valve means includes a stop against which openable ends of the strip can abut when in closed position.

11. A fume hood as set forth in claim 10, wherein there is a deflecting baffle adjacent the stop for the strips.

12. A fume hood as set forth in claim 11, wherein the baffle is directed downwardly and rearwardly.

13. A fume hood as set forth in claim 1, wherein the sash opens and closes in a horizontal direction.

14. A fume hood with an inlet for external air and a horizontally openable sash for operator access to an interior of the hood, wherein the improvement comprises: an air supply actuated valve including a series of movable strips for directing an air supply composed of external and room air through a sash opening into the hood when the sash is open, and for directing an air supply around the sash into the hood when the sash is closed.

* * * * *